US005582243A

United States Patent [19]

Velon

[11] Patent Number: 5,582,243

[45] Date of Patent: Dec. 10, 1996

[54] HEAT EXCHANGER WATER HEADER CONTAINING AN OIL COOLING RADIATOR

[75] Inventor: Guy Velon, Change, France

[73] Assignee: Valeo Thermique Moteur, Le Mesnil-Saint Denis, France

[21] Appl. No.: 500,692

[22] Filed: Jul. 11, 1995

[30] Foreign Application Priority Data

Jul. 15, 1994 [FR] France ..... 94 08818

[51] Int. Cl.[6] ..... F28D 7/10

[52] U.S. Cl. ..... 165/140

[58] Field of Search ..... 165/140, 916

[56] References Cited

U.S. PATENT DOCUMENTS 4,553,586 11/1985 Lardner ..... 165/916 X 4,665,972 5/1987 Potier ..... 165/76

FOREIGN PATENT DOCUMENTS 273996 9/1992 Japan ..... 165/140

*Primary Examiner*—Leonard R. Leo

*Attorney, Agent, or Firm*—Morgan & Finnegan, LLP

[57] ABSTRACT

A heat exchanger, especially a heat exchanger for use in a motor vehicle, has a water header which includes a hollow header cover in which an oil cooling radiator is fitted. The header cover comprises a side wall through which the two tubular connectors of the oil cooler are inserted. The header cover also has a curved wall lying opposite the side wall, so as to define an internal cavity which leaves enough space widthwise for the oil cooler to be fitted within the header cover. The latter has, in this internal cavity, an internal width which is greater than the overall width of the oil cooler, and, at the level of its open face, an internal width which is smaller than the overall width of the oil cooler.

8 Claims, 2 Drawing Sheets

HEAT EXCHANGER WATER HEADER CONTAINING AN OIL COOLING RADIATOR

FIELD OF THE INVENTION

This invention relates to a water header for a heat exchanger, in particular for a motor vehicle, of the kind comprising a header cover containing an oil cooler or oil cooling radiator.

BACKGROUND OF THE INVENTION

In known water headers of this type, the oil radiator has two oil inlet and outlet tubular connectors which extend sealingly through a side wall of the water header, i.e. of the header cover. The oil cooler is retained and fixed within the header by means of these tubular connectors. The header cover has an open face. The two tubular connectors of the oil cooler are connected to an oil circuit, such as the engine and/or gearbox lubricating oil circuit of the motor vehicle. The oil which flows through the oil cooler is cooled by the liquid flowing in the heat exchanger of which the header forms a part, this heat exchanger being typically the engine cooling radiator of the vehicle.

In these known types of water header, the oil cooler or radiator is introduced through the open face of the header cover, before the latter is fitted onto the end of a bundle of tubes, or on a heat exchanger body which will be covered by the open face of the header cover.

The oil cooler conventionally comprises a cylindrical body consisting of two concentric tubes which are closed at their ends, and to which the two oil inlet and outlet tubular connectors are connected, these two connectors extending in directions parallel to each other and at right angles to the longitudinal direction of the body of the oil cooler. Each of these tubular connectors has a base portion which is brazed onto the cylindrical body of the oil cooler, together with a threaded portion which, in cooperation with a nut, enables the oil cooler to be fixed onto the side wall of the header cover, with a sealing gasket being interposed.

In order that the oil cooler can be fitted into the header cover, it is necessary that the latter should have an internal width which is at least equal to the overall size of the oil cooler in the same dimension, that is to say the overall width of the oil cooler including its tubular connectors. In other words, the internal width of the header cover has to be at least equal to the diameter of the cylindrical body of the oil cooler plus the length of its tubular connectors.

Therefore, the water header must have a relatively large internal width, which is substantially greater than the width (or corresponding dimension) of the tube bundles or bodies of current heat exchangers. The internal width of the header cover is therefore disproportionate with respect to the dimension of the tube bundle or body of the heat exchanger.

In practice, this makes it necessary to provide specially designed header covers, as well as special header plates and sealing gaskets, in place of conventional or standard header covers and header plates and sealing gaskets which also form part of the water header, when it is required to have an oil cooler inside the header. This problem leads to substantial increases in cost, and this effect is even more marked when special tooling or machinery is required for assembling the heat exchanger.

In order to overcome these drawbacks it has been proposed, as disclosed in French patent application No. 85 04214, published under the number 2 579 309, to form in the side wall of the header cover apertures which are substantially larger in width than the external diameter of the tubular connectors of the oil cooler. Each of these two apertures may then be closed by an attached plate, which is formed with at least one hole in which one of the tubular connectors is closely engaged, this plate then being secured on the edge of the aperture.

This known solution does enable a header cover to be used which has external dimensions identical to those of a header cover that does not contain an oil cooler. However, it also calls for the provision and fitting of the additional separate plates mentioned above. This is a disadvantage.

DISCUSSION OF THE INVENTION

An object of the present invention is to provide a different solution, which is simpler than that mentioned above.

According to the invention, a heat exchanger water header, comprising a cover containing an oil cooling radiator having tubular oil inlet and outlet connectors which extend sealingly through a side wall of the header cover, and by means of through which the oil radiator is held and fixed in the header cover, the latter further having an open face. In which the structure is characterised in that the header cover includes, on the side opposite to the side wall, a curved wall which defines an internal cavity having a length which is at least equal to that of the oil radiator and which is adapted to leave enough space widthwise for the oil radiator to be fitted inside the header cover, and in that it has, in the region of the internal cavity an internal width which is greater than the overall width of the oil radiator, and at the level of the open face an internal width which is smaller than the said overall width.

In this way, the invention enables header plates and sealing gaskets of standard types to be used, while at the same time avoiding the provision and fitting of separate attached plates. In this connection, because of the internal cavity defined by the curved wall of the header cover, it is sufficient to introduce the oil cooler or radiator through the open face of the header cover in such a way that the body of the oil cooler is presented first, with the two tubular connectors of the latter extending in a direction substantially at right angles to the open face of the header cover.

The oil cooler is then pivoted in a movement which combines straight line and rotational movement, so that the body of the oil cooler reaches the base of the cavity, with the two tubular connectors of the oil cooler lying in the axis of the apertures formed in the side face of the header cover. All that is then necessary is to displace the oil cooler in the axis of the two apertures of the side wall of the header cover, so that it reaches the correct position.

In one embodiment of the invention, the curved wall extends over the whole length of the header cover. This curved wall preferably has a profile which is of generally cylindrical form.

When, as is usually the case, the oil cooler has a circular cylindrical body, the internal radius of the curved wall of the header cover is greater than the external radius of the oil cooler body. The cylindrical profile of the curved wall preferably extends over an angular sector lying between 120° and 190°.

According to a further preferred feature of the invention, the curved wall is joined to a junction wall portion which extends parallel to the front wall, and which terminates in a peripheral bead bounding the said open face.

It is preferably provided with internal ribs which are adapted to facilitate the positioning of the tubular connectors of the oil radiator in facing relationship with apertures formed in the side wall. These ribs preferably extend transversely, each of them being formed in a vault wall portion which joins the side wall to the curved wall of the header cover.

A preferred embodiment of the invention will be described below, by way of example only and with reference to the accompanying drawings.

DESCRIPTION OF A PREFERRED EMBODIMENT OF THE INVENTION

Figure 1:
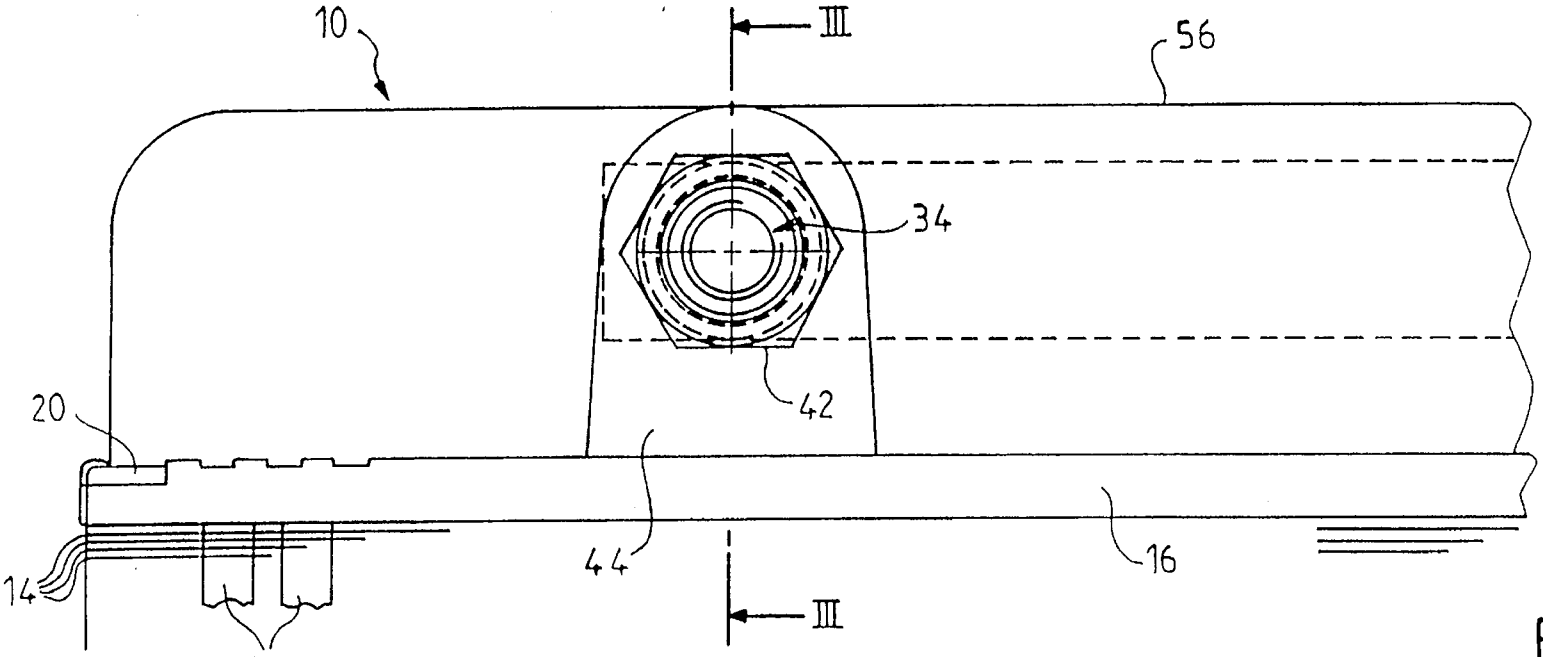
FIG. 1 is a partial view and elevation, of a motor vehicle heat exchanger header containing an oil cooler.
Figure 2:
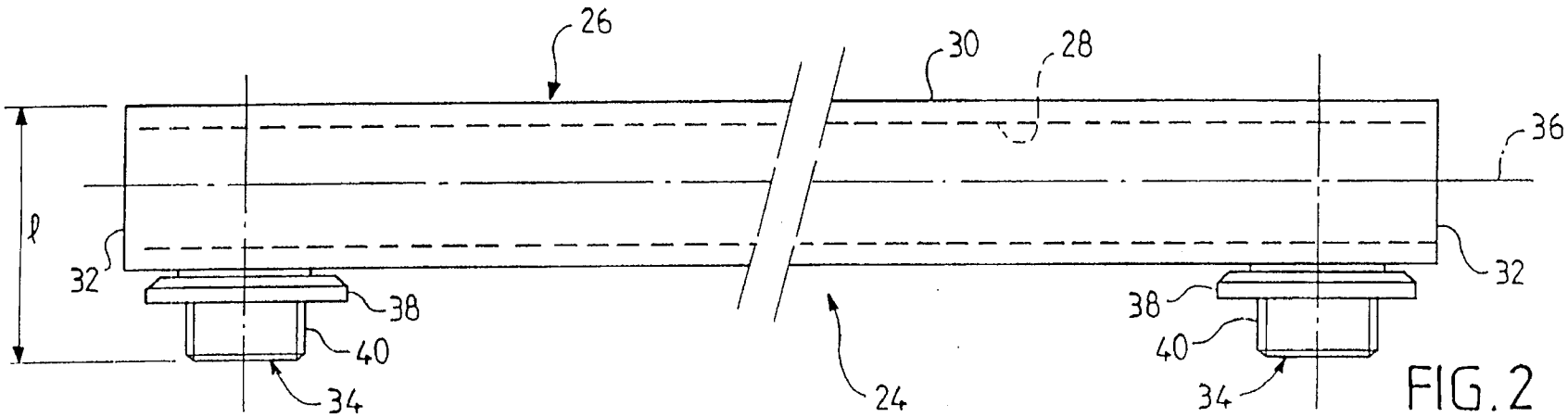
FIG. 2 is a elevation of the oil cooler contained in the header seen in FIG. 1.
Figure 3:
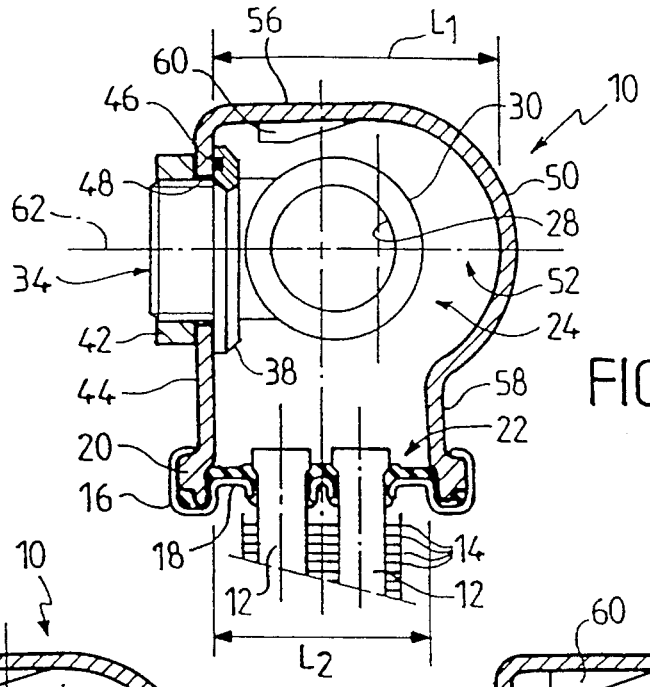
FIG. 3 is a view in cross section taken on the line III—III in FIG. 1.

Reference is first made to FIGS. 1 to 3, which show a water header of heater exchanger, such as a cooling radiator for a motor vehicle. The header comprises a header cover 10, which is mounted conventionally, by means of a tube plate or header plate 16, at one end of a bundle consisting of tubes 12 with fins 14. The header plate 16 is mounted through a sealing gasket 18 on a peripheral bead 20 of the header cover 10. This bead 20 bounds an open face 22 of the header cover as is best seen in FIG. 3.

The header cover 10 contains an oil cooling radiator 24 of the conventional tubular type, which is also shown in FIG. 2. The oil radiator 24 has a tubular body 26 which has two coaxial cylindrical walls 28 and 30, which are sealingly connected together at their ends 32, together with two tubular connections 34 which are arranged close to these axial ends and which are open into the annular space lying between the cylindrical walls 28 and 30. Each tubular connector 34 is orientated at right angles to the axis 36 of the tubular body 26 of the oil cooler, and comprises a base portion 38 which is brazed onto the outer wall 30 of the body 26, together with a threaded portion 40. The oil cooler 24 is secured on a side wall 44 of the header cover 10 by means of a nut 42 shown in FIGS. 1 and 3, with a sealing gasket 46 (see FIG. 3) interposed.

The side wall 34 of the header cover has two through apertures 48, in which the threaded portions 40 of the tubular connectors 44 are engaged respectively. The base portions 38 of the tubular connectors 34 are applied against the inner face of the side wall 44, with the sealing gasket 46 interposed, while the nuts 42, screwed onto the threaded portions 40 of the tubular connectors, are tightened against the outer face of the wall 44, so that the oil radiator 24 is held and fixed on the side wall 34 of the header cover. The two tubular connectors 44 can then be connected to an oil circuit by means of two male connecting pieces, not shown.

The oil radiator 24 has an overall width l (FIG. 2), which corresponds to the diameter of the tubular body 26 with the addition of the length of the tubular connectors 34.

As has been explained above, in the arrangements of the prior art, it has happened that the open face of the header cover has an internal width which is at least equal to the width of the oil cooler, so as to enable the latter to be introduced into the water header, except where separate attached plates are provided as in French patent specification No. 85 04214.

The present invention proposes another solution which enables a header cover to be used in which its open face has a reduced width, and which does not make it necessary to employ attached plates. In this connection, the header cover 10 includes, opposite to the side wall 44, a curved wall 50 which is concave towards the interior of the header cover, so as to define an internal cavity 52 which extends over a length at least equal to that of the oil cooler which it is intended to fit into the header. The curved wall 50 is joined to the wall 44 through an upper wall portion 56 constituting a vault, which is joined to the wall 44 at right angles to the latter.

The curved wall 50 may extend, either only over a length which is, however, at least equal to that of the oil cooler, or over the whole length of the water header.

The curved wall 50 has a generally cylindrical, circular form, the radius R of which (see FIG. 4A) is greater than the external radius of the tubular body 26 of the oil cooler 24. In addition, the cylindrical form of the curved wall 50 extends over an angular sector A (again seen in FIG. 4A), which preferably lies between 120° and 180°. As its other end, the curved wall 50 is joined to the bead 20 through a junction wall portion 58 which extends parallel to the side wall 44, and which terminates at the peripheral bead 20.

As can be seen in FIG. 3, the header cover 10 has an internal width L1 in the region of the internal cavity 52, i.e. in the axis 62 of the holes 48 in which the tubular connectors 34 are received. This internal width L1 is greater than the overall width l of the oil cooler 24. The internal width L2 of the header cover 10, at the level of its open junction face 22, is however smaller than the width l.

The header cover 10 has internal ribs 60 which, as will be seen later on in this description, facilitate the positioning of the tubular connectors of the oil cooler in facing relationship with apertures 48 formed in the side wall 44. These ribs 60 extend transversely, and are formed in the upper or vault wall portion 56 that connects the side wall 44 to the curved wall 50.

The method of fitting the oil cooler into the header cover will now be described with reference to FIGS. 4A to 4D.

Figure 4A:
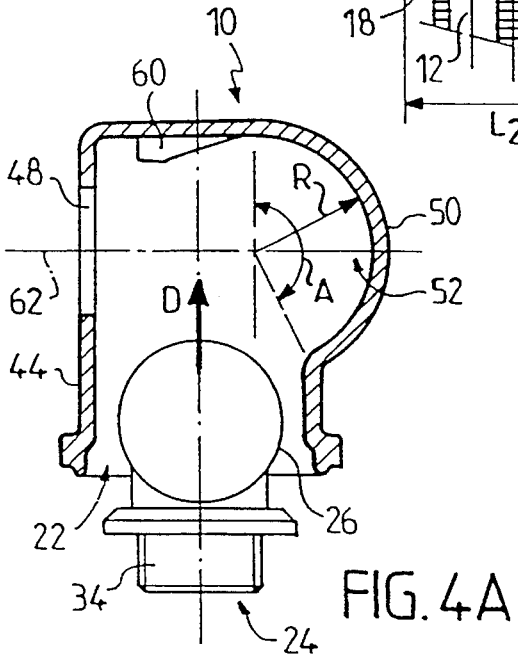
FIGS. 4A, 4B, 4C, and 4D are views similar to FIG. 3, but show respectively four successive phases in the fitting of the oil cooler into the header cover.

As is shown in FIG. 4A, the oil cooler 24 is introduced through the open face 22 in a direction of introduction D which is substantially at right angles to the plane of the open face 22, and which is accordingly substantially at right angles to the axis 62 of the apertures 48. The introduction of the radiator is then carried out in such a way that its tubular body 26 enters first, being followed by the tubular connectors 34, the respective axes of which are substantially parallel to the introduction direction D.

Figure 4B:
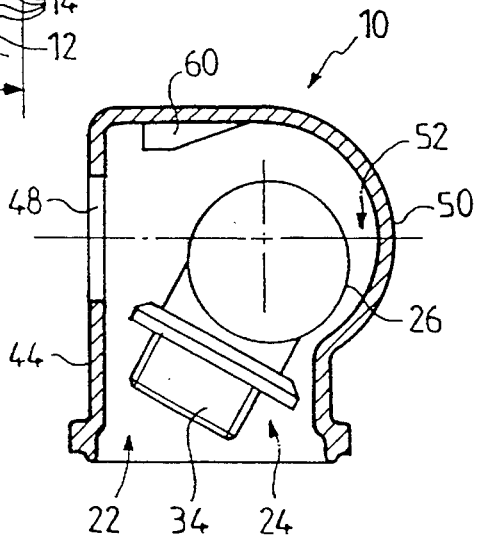
Figure 4C:
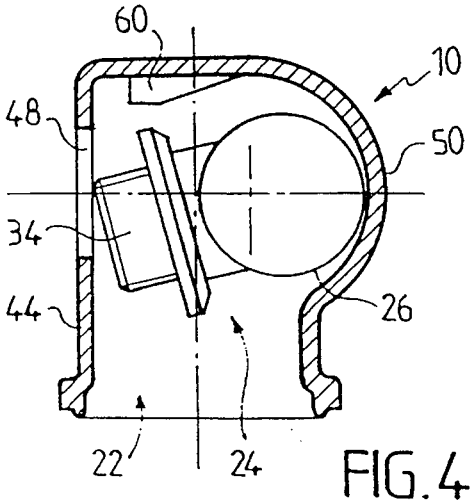
Figure 4D:
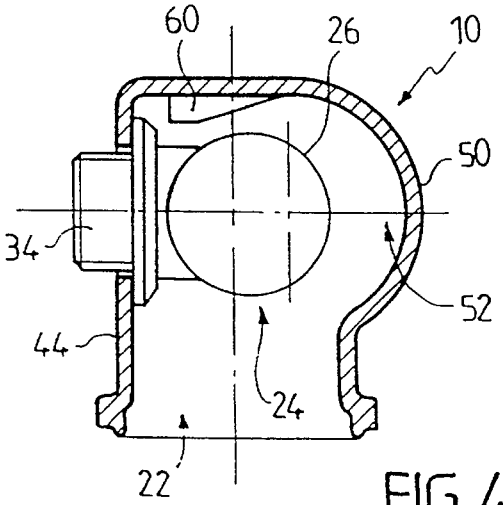

The introduction of the oil cooler 24 into the header cover is then continued by causing it to pivot so that the tubular body 26 is moved closer to the base of the cavity 52 (see FIG. 4B). This pivoting movement of the oil cooler is continued in the same direction, so that the respective axes of the tubular connectors move progressively closer to the axes 62 of the holes 48 (as can be seen in FIG. 4C). After rotation through about 90°, the two tubular connectors 34 then lie in facing relationship, and in alignment, with the holes 48. It is then sufficient to displace the oil cooler in straight line movement in order to fully engage the threaded portions 40 of the tubular connectors in the holes 48, as can be seen in FIG. 4D. Finally, the nuts 42 are fitted as described above.

It should be noted that the ribs 60 facilitate the positioning of the tubular connectors 34 in facing relationship with the holes 48 formed in the side wall of the header cover.

In this way, the invention enables a header cover to be employed, that has an internal width L2 at the level of its open face which is equal to that of the covers of conventional water headers having no oil cooler or radiator. In this way, a header plate 16 and a gasket 18 of standard dimensions can be used, and the assembly can be carried out by standard machinery.

The oil which is cooled in the oil cooler contained in the water header may be engine or gearbox lubricating oil of the motor vehicle, the oil cooler being connected in the appropriate lubrication circuit.

What is claimed is:

1. A heat exchanger water header comprising a hollow header cover having a length and an open face with an established width and a side wall extending from said open face, and an oil cooler having a predetermined length and width, two tubular connectors on said oil cooler for inlet and outlet of oil, respectively, and securing means, including said tubular connectors, said securing means extending sealingly through said side wall of said header cover for retaining and securing said oil cooler in said header, a curved wall on said header opposite to said side wall, said curved wall defining an internal header cavity, said header cavity having a length at least equal to said oil cooler length, said header cavity width enabling said oil cooler to be fitted inside said header cover, said header cover having an internal width in said header cavity greater than said oil cooler width, and said header cover open face width being smaller than said predetermined oil cooler width.

2. A water header according to claim 1, wherein said curved wall extends over the whole of said header cover length.

3. A water header according to claim 1, wherein said curved wall is generally a portion of a cylinder with an internal radius.

4. A water header according to claim 3, wherein said oil cooler has a cylindrical body having an external radius, the internal radius of said curved wall of the header cover being greater than the external radius of the body of the oil cooler.

5. A water header according to claim 3, wherein said cylindrical curved wall portion subtends an arc between 120° and 180°.

6. A water header according to claim 1, wherein the header cover further includes a junction wall portion parallel to said side wall, and a peripheral bead bounding said open face, said junction wall portion terminating at said peripheral bead and said curved wall being joined to the junction wall portion.

7. A water header according to claim 1, wherein said side wall is formed with through apertures for receiving said tubular connectors, said header cover further having internal ribs for facilitating the positioning of said tubular connectors in facing relationship with said through apertures.

8. A water header according to claim 7, further including a wall portion of the header cover defining a vault connecting said side wall and said curved wall together, said ribs being formed transversely in said vault wall portion.

* * * * *